United States Patent [19]

Kreeger et al.

[11] Patent Number: 4,508,237

[45] Date of Patent: Apr. 2, 1985

[54] COLLAPSIBLE CONTAINER

[75] Inventors: Elsmer W. Kreeger, Allegan; Edward L. Stahl, Brighton both of Mich.

[73] Assignee: Pinckney Molded Plastics, Inc., Pinckney, Mich.

[21] Appl. No.: 570,762

[22] Filed: Jan. 16, 1984

Related U.S. Application Data

[63] Continuation of Ser. No. 366,879, Apr. 9, 1982, abandoned.

[51] Int. Cl.[3] ..... B65D 6/18; B65D 21/02

[52] U.S. Cl. ..... 220/6; 220/7; 206/509

[58] Field of Search ..... 220/4 F, 6, 7; 206/509

[56] References Cited

U.S. PATENT DOCUMENTS

| | | | |
|---|---|---|---|
| 1,422,692 | 7/1922 | Gibbons | 220/6 |
| 1,769,019 | 7/1930 | Flagstad | 220/6 |
| 2,486,532 | 11/1949 | Kubach | 220/6 |
| 2,512,522 | 6/1950 | Denny | 220/7 |
| 2,558,126 | 6/1951 | Davenport | 220/6 |
| 3,186,585 | 6/1965 | Denny | 220/6 |
| 3,796,342 | 3/1974 | Sanders | 220/7 |
| 4,062,467 | 12/1977 | Fredrich | 220/7 |

FOREIGN PATENT DOCUMENTS

| | | | |
|---|---|---|---|
| 1048423 | 2/1979 | Canada | 220/7 |
| 1494178 | 7/1967 | France | 220/6 |

*Primary Examiner*—George E. Lowrance

*Attorney, Agent, or Firm*—Basile, Weintraub & Hanlon

[57] ABSTRACT

A collapsible container includes opposed side walls hingedly connected along their upper and lower edges respectively to the bottom of a rectangular peripheral upper rim and to the bottom of the container along opposed side edges of the rim and bottom. End walls are hingedly connected along their upper edges to the rim along its opposed end edges. Webs along the end edges of the side walls and bottom engage the end walls to locate the end walls in their vertical erected position relative to the bottom, and projecting tabs on the end walls are received in mating recesses in the web to maintain the bottom and side walls against flexing when the container is erected. The upper rim is adapted to receive a stacking rail formed on the container bottom to enable stacking of the containers either in their erected or collapsed configuration.

The container may include a pair of cover panels hinged along their respective outer side edges to the tops of the side edges of the rim. The end edges of the cover panels are formed with rim receiving grooves on their lower sides which snugly receive the end edges of the rim when the cover panels are closed. The cover panels are formed with a stacking rail receiving recess in their upper surfaces.

3 Claims, 8 Drawing Figures

COLLAPSIBLE CONTAINER

This application is a continuation of application Ser. No. 366,879, filed Apr. 9, 1982, now abandoned.

BACKGROUND OF THE INVENTION

The present invention is concerned with a collapsible container usable in shipping products, such as bagged potato chips. Bagged potato chips conventionally are shipped or delivered in the familiar cardboard carton which, while adequate for its intended purpose, is normally used only once and then discarded.

By constructing a shipping container of plastic material, such as polypropylene, and forming the container in a manner such that it can be collapsed for convenient return to the source of the goods, a single container may have a useful life of literally hundreds of deliveries.

Where such containers are used to handle bulky, low-density articles, such as the potato chips referred to by way of example, the containers may be of a relatively light-weight construction, needing structural rigidity when in their erected position only such that a reasonable number of loaded containers may be stacked, one upon the other, and that side loading forces, such as those normally encountered in transportation and handling, will be adequately resisted.

While the prior art discloses many examples of collapsible containers designed for repeated use in the transport and handling of uniformly sized products, such as bread loaves, etc., the prior art containers of this type normally rely upon the rigidity of the individual walls or panels for structural rigidity of the container, whereas in many instances longer useful life of the container may be achieved if the container walls have some degree of flexibility. A second drawback of the prior art is its lack of practical constructions for collapsible containers in which the container may be provided with a cover.

SUMMARY OF THE INVENTION

In accordance with the present invention, a collapsible container is formed with a pair of opposed side walls which are hinged along their upper and lower edges respectively to two opposed side edges of an upper rim and to two opposed side edges of a rectangular bottom. The upper rim is of open rectangular configuration and is hingedly connected to the side walls at its lower side. A pair of opposed end walls are hingedly connected to the bottom of the end sections of the rim along the upper edges of the end wall. Inwardly projecting webs on the end edges of the side wall and an upwardly projecting web along the end edges of the bottom provide abutment surfaces which locate and maintain the end walls in vertical relationship to the bottom when the container is in its erected position. Projecting tabs on the outer surfaces of the end walls fit into complementary openings in the webs to resist outward bowing or flexing of the side walls and bottom when the container is erected. A downwardly projecting stacking rail on the bottom of the bottom is configured to be received within the rim of a like container to enable a plurality of containers to be stacked in stable relationship, one upon the other, when the containers are in either of their erected or collapsed configurations.

Where a covered container is required, a pair of cover panels are hingedly connected to the two opposed side edges of the rim along the top of the rim. Downwardly opening grooves or recesses formed on the underside of the cover panels near their end edges are conformed to snugly fit onto the end edges of the rim when the cover is closed to rigidify the assembly. The upper surfaces of the cover are formed to receive the stacking rails of a like container to accommodate stacking of the container when the covers are closed.

Other objects and features of the invention will become apparent by reference to the following specification and to the drawings.

IN THE DRAWINGS

Figure 1:
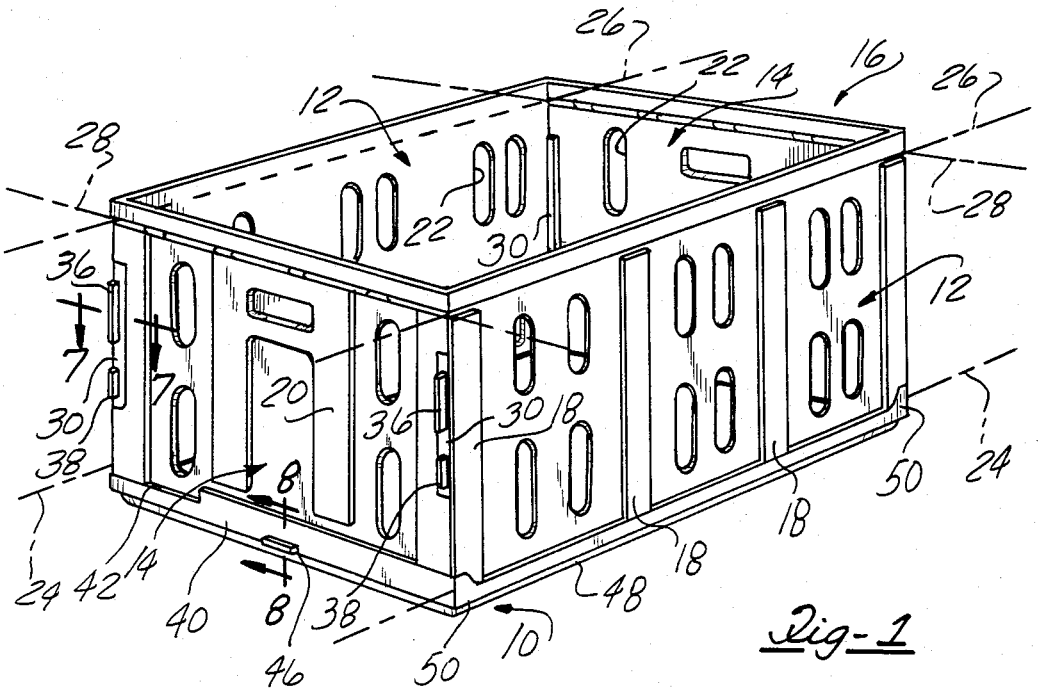
FIG. 1 is a perspective view of one form of container embodying the present invention, showing the container in its erected configuration.

Referring first to FIG. 1, the major elements of one form of container embodying the present invention include a rectangular bottom designated generally 10, a pair of opposed side walls designated generally 12, a pair of end walls designated generally 14 and an open rectangular upper rim designated generally 16. All of these components are preferably formed from a suitable thermoplastic material, such as polypropylene, which possesses some degree of flexibility and which can accommodate the employment of so-called living hinges in which two adjacent parts are integrally formed with a hinge connection between the two parts constituted by a groove along the line of juncture of the two parts establishing a line of reduced thickness about which the two parts can be flexed or hinged. The side and end walls of the container may be stiffened to some extent by ribs such as 18 and 20, and suitably located openings such as 22, shown only in FIG. 1, may be provided for weight reduction.

Side walls 12 are hingedly connected along their lower edges to the corresponding side edges of bottom 10 for hinging movement relative to the bottom along a hinge axis indicated at 24 in FIG. 1. Side walls 12 are also hingedly connected along their upper edges to the bottom of the corresponding sides of upper rim 16 for hinging movement relative to the rim about hinge axes indicated in broken line at 26 in FIG. 1.

End walls 14 are hingedly connected at their upper edges to the bottom of rim 16 along the end sections of rim 16 for hinging movement about hinge axes indicated in broken line at 28 in FIG. 1.

The hinge connections referred to above may take the form of living hinges or conventional hinges at the option of the designer.

Figure 2:
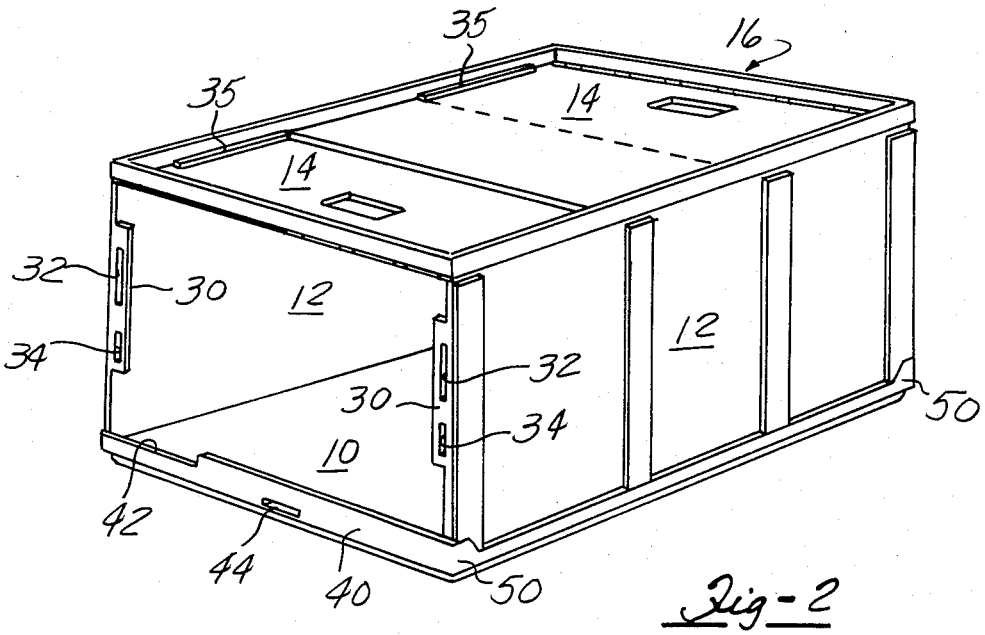
FIG. 2 is a perspective view of the container of FIG. 1, with certain details omitted, showing a first stage of the collapsing of the container.
Figure 7:
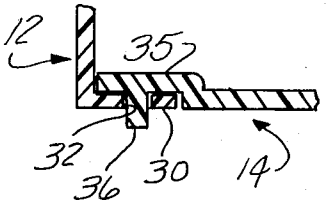
FIG. 7 is a detailed cross-sectional view taken on line 7—7 of FIG. 1.

At each of the end edges of side walls 12, an inwardly projecting web 30 is formed with slots 32, 34 (see particularly FIG. 2). End walls 14 are formed with a laterally inset side edge section 34, see particularly FIG. 7, conformed to receive the web 30 when the container is in the erected position of FIG. 1. Forwardly projecting tabs 36, see FIG. 7, pass through the slots 32 and 34 when the container is in its fully erected position to retain side walls 12 against outward flexing movement, such as might occur when the erected container must support the weight of a plurality of other containers stacked upon it. The webs 30 on side walls 12 also serve as a stop which engages the outer surfaces of end walls 14 to establish the erected position of the end walls relative to the side walls.

Bottom 10 is formed with upwardly extending webs 40 which extend from one side edge of the container along the end edges of the bottom over a major portion of the end edges, as best seen in FIG. 2. Webs 40 do not extend the entire length of the end edges of the bottom, but terminate at a reduced height section 42 which is substantially flush with the surface of the bottom at the opposite side of the container, the reduced height section 42 being provided for a purpose to be described below. A slot 44 (FIGS. 2 and 8) is cut through web 40 and dimensioned to receive outwardly projecting tabs 46 (FIGS. 1 and 8) integrally formed upon end walls 14 adjacent their lower edge. When the container is erected, the seating of the tabs 46 within slots 44 stiffens the bottom 10 against flexing.

Figure 8:
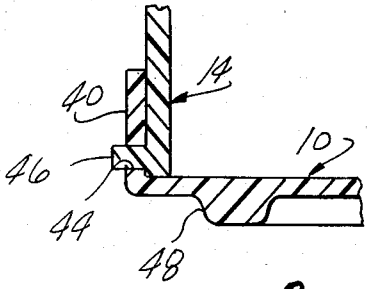
FIG. 8 is a detailed cross-sectional view taken approximately on the line 8—8 of FIG. 1.

As best seen in FIG. 8, a downwardly projecting stacking rail 48 is integrally formed on the bottom, the rail 48 extending in parallel relation to the associated edges of the bottom. The outer peripheral dimensions of stacking rail 48 and the inner peripheral dimensions of upper rim 16 are matched so that the containers may be stably stacked one upon the other with the stacking rails 48 projecting downwardly into the interior of the rim 16 of an underlying container. Stable stacking of a plurality of like containers may thus be achieved when the containers are in their erected position and, as will be described below, stable stacking may also be achieved when the containers are in their collapsed position.

Figure 3:
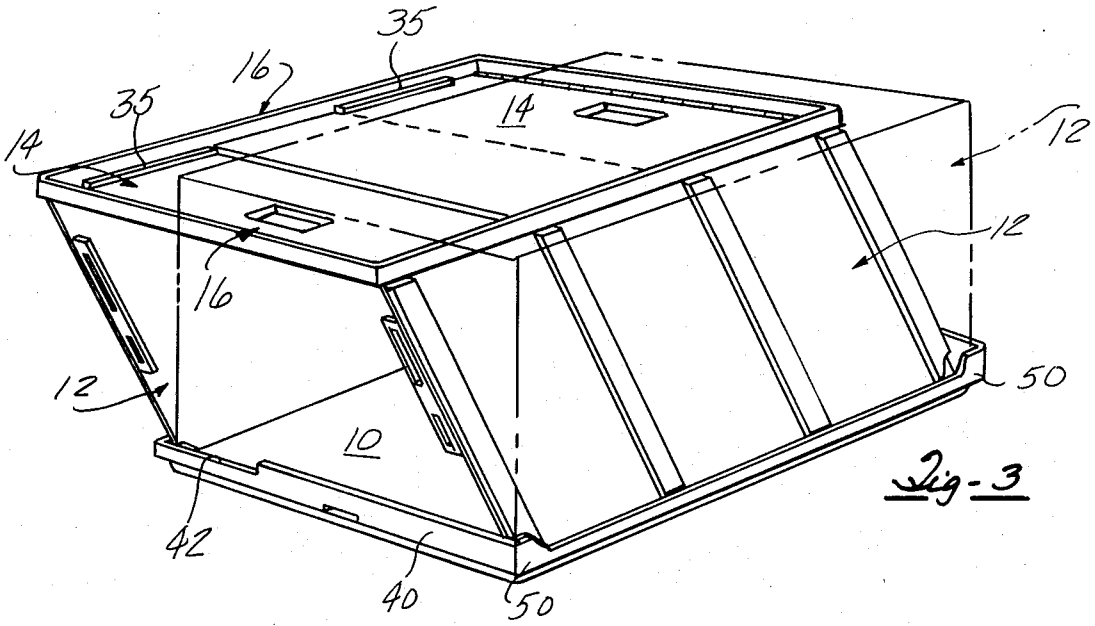
FIG. 3 is a perspective view, similar to FIG. 2, showing a successive stage in the collapsing of the container.
Figure 4:
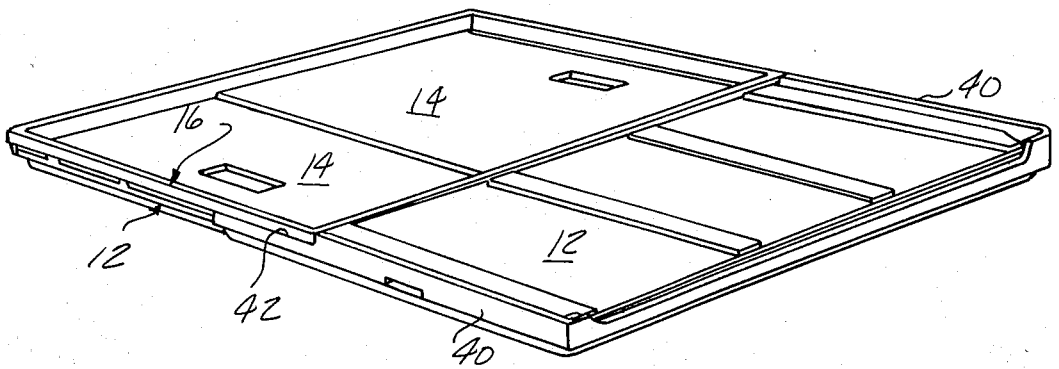
FIG. 4 is a perspective view showing the container in its fully collapsed position.

The erected container as shown in FIG. 1 may be collapsed into the substantially flat configuration shown in FIG. 4 in steps sequentially shown in FIGS. 2, 3 and 4.

To collapse the container from the position shown in FIG. 1, the end walls 14 of the container are hinged upwardly and inwardly about their hinge axes 28 to a substantially horizontal position shown in FIG. 2 in which end walls 14 lie at or slightly above the hinge axes 26 between the upper edges of side walls 12 and rim 16. With the end walls in this latter position, the side walls 12 are then hinged in unison to the left as viewed in FIGS. 2 and 3 and downwardly about hinge axes 24 which connect the lower edges of the side walls to the bottom. In order to achieve the most compact collapsed position, this latter hinging action may take place in only one direction, stops 50 (FIG. 3) being formed on bottom 10 to require the hinging action to occur only in the direction illustrated. This requirement for collapsing of the side walls in only one direction assures that when the container is fully collapsed, as indicated in FIG. 4, the rim 16 is seated in the reduced height section 42 of the upwardly projecting webs 40 on bottom 10 so that the top of rim 14 is substantially flush and coplanar with the top of the webs 40 on bottom 10.

Figure 5:
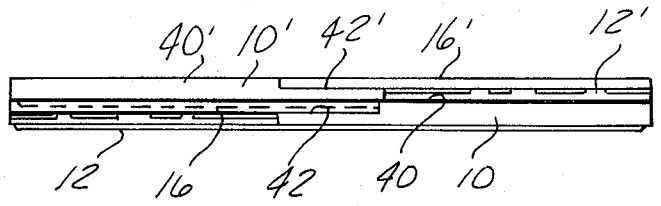
FIG. 5 is a side elevational view showing two containers of the type shown in FIG. 1 stacked one upon the other in the collapsed position.

It will be noted that in the fully collapsed position of the container shown in FIG. 4, rim 16 projects upwardly from the collapsed end walls 14 to form a pocket which can receive and retain the stacking rail 48 of a like container. In FIG. 5, the manner of stacking collapsed containers is shown, the parts of the uppermost of the two stacked collapsed containers being designated by primed reference numerals. In stacking collapsed containers, the bottoms of the individual containers are located successively on alternate sides of the stack.

Figure 6:
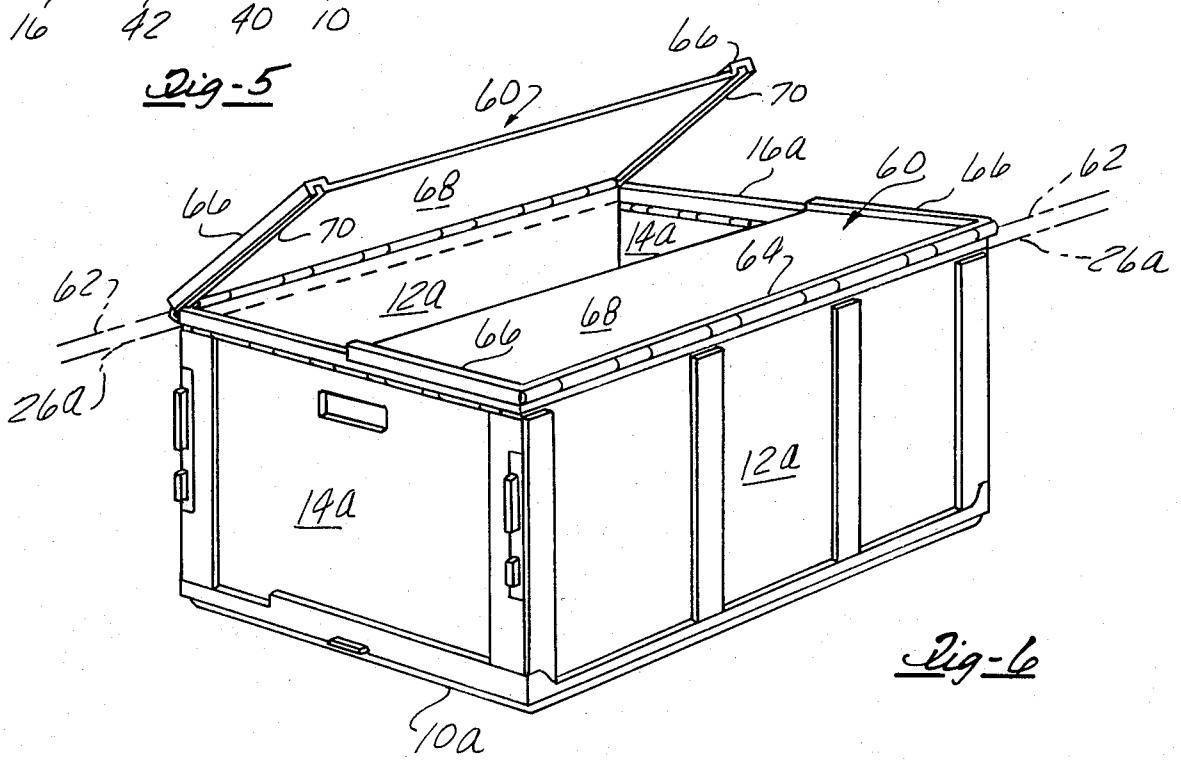
FIG. 6 is a perspective view of a modified form of container which differs from that of FIG. 1 in the inclusion of a cover.

A modified form of container is illustrated in FIG. 6, the FIG. 6 embodiment differing from that of FIGS. 1–5 in that the FIG. 6 embodiment is provided with a cover. Parts common to the FIG. 1 embodiment are identified in FIG. 6 by corresponding reference numerals with the suffix "a".

The relationship between the bottom **10*a*, side walls 12*a*, end walls 14*a* and rim 16*a* of FIG. 6 is the same as between the corresponding parts of the embodiment of FIG. 1, although preferably the rim 16*a* of the FIG. 6 embodiment may have a somewhat smaller transverse thickness than the rim 16 of FIG. 1. Thus, a detailed description of the bottom, side walls, end walls and rim of FIG. 6 will be omitted since it would be repetitive of the foregoing description of the FIG. 1** embodiment.

In FIG. 6, a container cover is provided by two cover panels designated generally 60, each of which is dimensioned to cover one-half of the top of the container. Cover panels 60 are hingedly connected to the top of the side edges of rim **16*a* for hinging movement along a hinge axes 62 which are vertically displaced, by the height of rim 16*a*, from the hinge axes 26 between the side walls 12*a* and rim 16*a***.

The outer side edge of each of cover panels 60 is formed with a thickened flange 64 and corresponding flanges 66 extend along the respective end edges of each cover 60. The flanges 64 and 66 project above the general plane of the main panel portion 68 of the covers 60. Along the underside of each of the end flanges 66, downwardly opening grooves 70 are formed and dimensioned to snugly receive the upper edges of the corresponding sides of rim **16*a*** when the covers are in their closed position.

When closed, the opposed edges of the two panels 60 are in abutting relationship with each other. The flanges 64 and 66, when the covers are closed, provide a pocket for the reception of the stacking rail **48*a* of a like container, and stacking of containers of the FIG. 6 embodiment is performed in the same manner as described above in connection with FIG. 1, with the exception that in the FIG. 6 embodiment the stacking rail of the uppermost container is received within the flanges 64, 66 of the cover of the underlying container, as opposed to the seating of the stacking rail within the rim 16 in the case of the FIG. 1** embodiment.

While two embodiments of the invention have been described in detail, it will be apparent to those skilled in the art that the embodiments described may be modified. Therefore, the foregoing description is to be considered exemplary rather than limiting, and the true scope of the invention is that defined in the following claims.

What is claimed is:

1. In a collapsible container having a flat horizontal rectangular bottom, stacking rail means projecting downwardly from the underside of said bottom in parallel relationship to the ends and sides of said bottom, a rigid rectangular upper peripheral rim dimensioned to receive the stacking rail means of a like container to support said like container upon said rim while retaining said like container against horizontal displacement relative to said rim, a pair of opposed side walls, first hinge means coupling the lower edges of each of said side walls to said bottom along the respective opposite side edges thereof, second hinge means coupling the upper edges of said side walls to the underside of said rim along the respective side edges thereof, a pair of end walls, the length of said end walls exceeding the height of said side walls, third hinge means coupling the upper edges of said end walls to the underside of said rim along the respective end edges thereof, said hinge means accommodating movement of said bottom, side walls, end walls and rim relative to each other between an erected position wherein said side and end walls extend vertically upwardly from said bottom and a collapsed position wherein said end walls project horizontally inwardly from said end edges of said rim and said side walls are disposed in horizontal positions wherein one of said side walls lies upon said bottom and the other side wall projects horizontally outwardly from its associated side of said bottom;

the improvement comprising stop means on said bottom engageable with said one of said side walls when said one of said side walls is in its erected position to prevent hinging movement of said one of said side walls outwardly from said bottom, a pair of first vertical web means, each having an elevated section, extending along the respective ends of said bottom from that side of said bottom at which said one of said side walls is located for a distance substantially equal to, but less than, the height of the side wall, and a lower section extending from the end of said elevated section to the opposite side of said bottom, said first web means being respectively located outwardly of the opposite ends of said one of said side walls to receive said one of said side walls therebetween when in its collapsed position and said elevated sections having a height above said lower sections equal to the vertical thickness of said rim whereby the end edges of said rim rest upon said lower sections and define an extension of said elevated sections when said side and end walls are in their collapsed positions.

2. The invention defined in claim 1 wherein each of said first web means is engageable with the outer side of the adjacent end wall when said end walls are in their erected position to prevent hinging movement of said end walls outwardly of said bottom beyond said erected position.

3. The invention defined in claim 2 further comprising a pair of rectangular cover panels each hingedly connected along one edge respectively to the top portions of said opposed side edges of said rim for hinging movement to and from horizontal closed positions wherein said cover panels cooperatively close the top of said container with the respective edges of said panels opposite said one edge in abutting relationship with each other, said cover panels having means defining rim receiving grooves in the underside of said panels along the end edges thereof adapted to snugly receive the opposed end portions of said rim therein when said panels are in their closed positions.

* * * * *